US010638808B2

(12) United States Patent
Wilkins et al.

(10) Patent No.: US 10,638,808 B2
(45) Date of Patent: May 5, 2020

(54) HEAD AND NECK SUPPORT

(71) Applicant: The Boeing Company, Chicago, IL (US)

(72) Inventors: Donald F. Wilkins, Chicago, IL (US); Joshua Lee Downs, Chicago, IL (US); Ronald H. Berzins, Chicago, IL (US)

(73) Assignee: The Boeing Company, Chicago, IL (US)

( * ) Notice: Subject to any disclaimer, the term of this patent is extended or adjusted under 35 U.S.C. 154(b) by 113 days.

(21) Appl. No.: 15/922,498

(22) Filed: Mar. 15, 2018

(65) Prior Publication Data

US 2019/0281916 A1 Sep. 19, 2019

(51) Int. Cl.
*A42B 3/04* (2006.01)
*A41D 13/05* (2006.01)

(52) U.S. Cl.
CPC ..... *A42B 3/0473* (2013.01); *A41D 13/0512* (2013.01); *A42B 3/0433* (2013.01); *A41D 13/0556* (2013.01)

(58) Field of Classification Search
CPC .... A42B 3/0473; A42B 3/0433; G01L 9/0091
See application file for complete search history.

(56) References Cited

U.S. PATENT DOCUMENTS

2006/0260027 A1* 11/2006 Rhodes ..... A42B 3/0473 2/421
2008/0209617 A1* 9/2008 Castillo ..... A41D 13/0512 2/461
2017/0191341 A1* 7/2017 Fripp ..... E21B 23/06
2018/0028091 A1* 2/2018 Huang ..... A42B 3/0473
2018/0368490 A1* 12/2018 Suddaby ..... A41D 13/0512

OTHER PUBLICATIONS

MRF Technology, New Linear Magnetic Actuators Versionl .1, Cedrat Technologies, Jan. 2007, 2 pages.*
MRF Technology, New Linear Magnetic Actuators Version1.1, Cedrat Technologies, Jan. 2007, 2 pages.
Liquid Body Armor; https://www.youtube.com/watch?v=NcHMVj43UMM; published on Jan. 23, 2014.

* cited by examiner

*Primary Examiner* — Khoa D Huynh
*Assistant Examiner* — Erick I Lopez
(74) *Attorney, Agent, or Firm* — McDonnell Boehnen Hulbert & Berghoff LLP

(57) ABSTRACT

Example implementations relate to providing head and neck support. An example system includes a helmet, a load bearing harness, and a flexible extension coupled between the helmet and the load bearing harness. An activation of a magnetic field proximate the flexible extension causes a ferromagnetic infused medium to transition from a fluid state to a substantially rigid state causing the flexible extension to transition from a flexible state to a rigid state. When the flexible extension is in the rigid state, force applied to the helmet transfers through the flexible extension to the load bearing harness. The system further includes a sensor configured to detect an event. Particularly, the sensor causes the activation of the magnetic field proximate the flexible extension in response to detecting the event.

20 Claims, 3 Drawing Sheets

HEAD AND NECK SUPPORT

FIELD

The present disclosure relates generally to equipment to protect a user, and more particularly to, examples for providing head and neck support to a user during an impact.

BACKGROUND

A helmet is designed to protect the head of a user by absorbing impact force and protecting against penetration to reduce injury. The helmet helps absorb and distribute the impact force to reduce lacerations, contusions, skull fractures, and brain injuries. Although helmets can help decrease the impact to a user's head, other body parts of the user remain vulnerable during the impact, including the user's neck and spine. As a result, the impact force often flows from the head into the user's neck and spine, which can produce serious injuries such as herniated disks, fractured vertebrae, and crushing or severing of the spinal column, to name a few. In some instances, the duration of the impact can be very short, measured in milliseconds.

SUMMARY

In one example, a system is described comprising a helmet, a load bearing harness, and a flexible extension coupled between the helmet and the load bearing harness. An activation of a magnetic field proximate the flexible extension causes a ferromagnetic infused medium to transition from a fluid state to a substantially rigid state causing the flexible extension to transition from a flexible state to a rigid state. When the flexible extension is in the rigid state, force applied to the helmet transfers through the flexible extension to the load bearing harness. The system further includes a sensor configured to detect an event. The sensor causes the activation of the magnetic field proximate the flexible extension in response to detecting the event.

In another example, an apparatus is described. The apparatus includes a helmet configured to cover a head of a user when the apparatus is worn and a load bearing harness configured to position over shoulders of the user when the apparatus is worn. The apparatus also includes a flexible extension coupled between the helmet and the load bearing harness. An activation of a magnetic field proximate the flexible extension causes a ferromagnetic infused medium to transition from a fluid state to a substantially rigid state within the flexible extension causing the flexible extension to transition from a flexible state to a rigid state.

In a further example, a method is described. The method includes detecting an event using a sensor and responsive to detecting the event, causing an activation of a magnetic field proximate a flexible extension coupled between a helmet and a load bearing harness. The activation of the magnetic field proximate the flexible extension causes a ferromagnetic infused medium to transition from a fluid state to a substantially rigid state within the flexible extension causing the flexible extension to transition from a flexible state to a rigid state. When the flexible extension is in the rigid state, forced applied to the helmet transfers through the flexible extension to the load bearing harness.

The features, functions, and advantages that have been discussed can be achieved independently in various examples or may be combined in yet other examples further details of which can be seen with reference to the following description and drawings.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying drawings, wherein:

DETAILED DESCRIPTION

Figure 2:
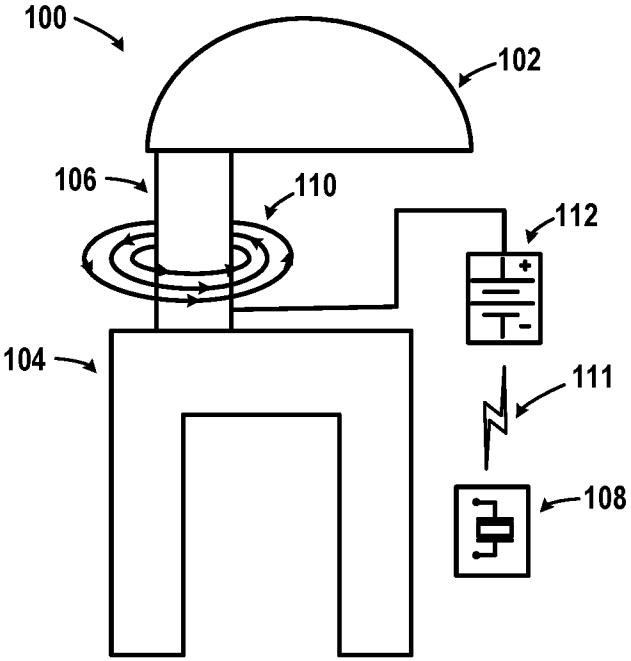
FIG. 2 is another conceptual illustration of the system, according to an example implementation.

Disclosed examples will now be described more fully hereinafter with reference to the accompanying drawings, in which some, but not all of the disclosed examples are shown. Indeed, several different examples may be described and should not be construed as limited to the examples set forth herein. Rather, these examples are described so that this disclosure will be thorough and complete and will fully convey the scope of the disclosure to those skilled in the art.

Example implementations describe methods and systems for providing head and neck support to a user. An example system can involve components configured to detect an impact (or near term impact) and responsively align the head, neck, and body of a user to help reduce damage caused by the impact. A helmet in the system is coupled to a load bearing harness via a flexible extension such that impact force incurred at the helmet can be distributed into the load bearing harness.

Within the system, the flexible extension serves as a malleable connection between the helmet and the load bearing harness when an impact is not imminent. The flexible extension, however, can also harden in impact situations to help align the user's head and body in a position that can reduce injury. By changing from a flexible state to a rigid state, the flexible extension along with the helmet and load bearing harness can help provide head and neck support that can protect vulnerable body parts (i.e., head, neck, and spine) of the user wearing the system. The system can also limit the rate of acceleration of the head due to impact to within acceptable limits as well as preventing movement beyond normal physical thresholds by varying the levels of rigidity of the flexible extension over time. Once the impact has passed, the system returns to a malleable state enabling the user to resume normal movements of their head. In some cases, the system is further designed to protect against subsequent impacts as well.

The flexible extension can become rigid as a result of ferromagnetic infused medium or a similar fluid transitioning into a substantially rigid state inside the flexible extension. Ferromagnetic infused medium is a combination of a carrier fluid with nanoscale particles of magnetite, hematite, or some other compound containing iron. The particles are small enough that thermal agitation disperses them evenly within the carrier fluid allowing the ferromagnetic infused medium to flow as a fluid. The particles, however, can also alter the state of the ferromagnetic infused medium (i.e., transition from fluid to substantially rigid) as a reaction to a nearby magnetic field. The magnetic field magnetizes the particles within the carrier fluid causing the ferromagnetic infused medium to transition from the fluid state to the substantially rigid state. When this transition occurs within the flexible extension, the flexible extension also becomes rigid. As such, removal of the magnetic field can cause the ferromagnetic infused medium to return back to the fluid state.

Prior to an impact event, the flexible extension remains flexible enabling a user wearing the helmet and load bearing harness to move naturally with minimal restraint. The user can change the orientation of their head relative their body to look around and perform other natural movements. When an impact occurs or is about to occur (i.e., an event), however, the system can cause the flexible extension to become rigid. By transitioning into the rigid state, the flexible extension along with the helmet and load bearing harness can help align a user in a manner that provides head and neck support. The alignment of the user can help reduce injury sustained from impact. Further, the system can also transfer impact energy from the helmet through the flexible extension into the load bearing harness. As a result, both the flexible extension in the rigid state and the load bearing harness can help receive and distribute impact energy in a manner that reduces its effect on the user's head, neck, and spine.

As indicated above, in order for the system to reduce injury to the user from an impact, ferromagnetic infused medium or another state-changing fluid can transition from a fluid state to a substantially rigid state inside the flexible extension. Example implementations described herein discuss using ferromagnetic infused medium, but other state-changing fluids can also be used within implementations. For example, another implementation can use sheer thickening fluid (STF) composed of hard particles of silica suspended in polyethylene glycol to alter the flexibility of the flexible extension. Magneto rheological fluids (MRFs) are also another option that can be used within examples. An MRF is a smart fluid configured to change rheological properties (e.g., viscosity) in the presence of a magnetic field similar to STF and ferromagnetic infused medium. Other mediums are possible.

In order to activate a magnetic field proximate the flexible extension, the system can include a sensor that is configured to detect an event and responsively cause the activation of the magnetic field. For example, the event can correspond to the detection of an impact or an indication of a near-term impact. In response to detecting the event, the sensor is configured to cause the activation of a magnetic field proximate the flexible extension, which in turn can cause ferromagnetic infused medium to transition from a fluid state to a substantially rigid state inside the flexible extension.

In some examples, the sensor detects an impact and transmits an electric current proximate the flexible extension to produce the magnetic field. In other examples, the sensor detects an impact or near term impact and provides a signal to a power supply to produce the electric current proximate the flexible extension. The sensor and power supply can be separate components or a single component within examples.

In further examples, the strength of the magnetic field can vary depending on the desired state of the flexible extension and ferromagnetic infused medium. For example, the system can use a strong magnetic field to quickly harden the flexible extension to prevent any movement during an impact. In other instances, the system can use a weaker magnetic field to semi-harden the ferromagnetic infused medium. By controlling the magnetic field, the system can transition between a flexible, free movement configuration for the user and a configuration aimed to protect the user's head, neck, and spin.

Figure 1:
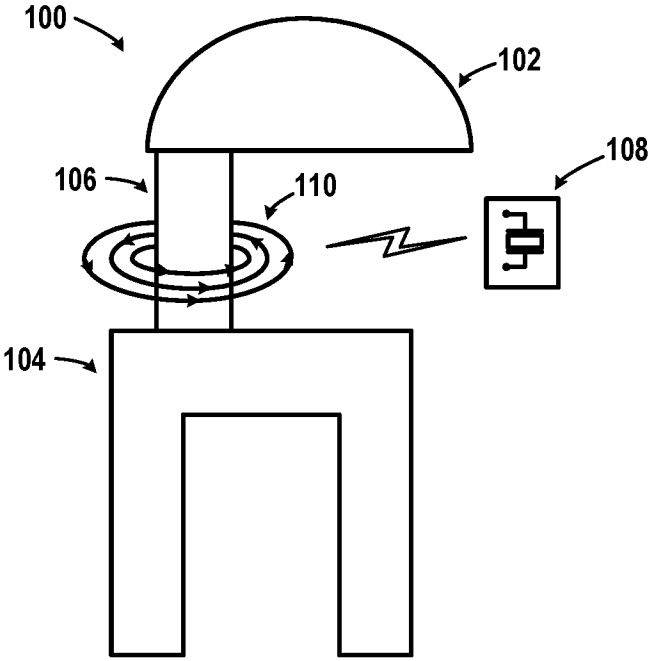
FIG. 1 is a conceptual illustration of a system, according to an example implementation.

Referring now to the Figures, FIG. 1 is a conceptual illustration of a system 100, according to an example implementation. The system 100 represents an example configuration for a system that can provide head and neck support to a user during an impact. The system 100 includes a helmet 102, a load bearing harness 104, a flexible extension 106, and a sensor 108. Other implementations can include more or fewer components in different arrangements. Additional configurations are described below.

The helmet 102 represents an article of protective headgear that is configured to cover the head of a user when the system 100 is worn. Within examples, the helmet 102 can vary in type, size, materials, and configuration depending on the desired use of the system 100. In some examples, the helmet 102 can be constructed using multiple materials, such as a foamed polymer liner, an expanded polystyrene, various metals, plastics, leather, or fibrous materials.

In an example implementation, the helmet 102 is a flight helmet configured for use by a pilot or aircraft passenger. The helmet 102 is configured to be worn by a user on the head of the user. As a flight helmet, the helmet 102 can provide impact protection to reduce the risk of head injury in the event of a parachute landing and can also provide protection from wind blast (e.g., in the event of an ejection of the user from the aircraft). The helmet 102 can include a visor to shield a user's eyes from sunlight, flash, laser beams, etc., and can also include other features, such as noise attenuation, headphones, a microphone, and a helmet mounted display. The helmet 102 can also be compatible with an oxygen mask.

In another example implementation, the helmet 102 can correspond to a type of helmet configured for protection during athletic activities, such as bicycle riding or a particular sport. For example, the helmet 102 can be a football helmet that is part of an overall system aimed to reduce injuries incurred from tackles and other collisions that occur during games and practices. As such, the helmet 102 can include additional features specific to the desired use of the system 100, such as a facemask, visor, and chin strap, among others. The example uses above are included for illustration purposes, but helmets within examples can be configured for other uses not described herein.

The load bearing harness 104 is a component within the system 100 that is configured to absorb and distribute impact force. In particular, the load bearing harness can receive impact force from the helmet 102 through the flexible extension 106 when the flexible extension is rigid. Although the load bearing harness 104 is shown in FIG. 1 having a structure that is configured to cover the shoulders of a user, the load bearing harness 104 can have other sizes and configurations within other examples. For example, the load bearing harness 104 can couple around the torso of a user similar to a thick belt. In addition, the materials of the load bearing harness can vary depending on the desired use of the system 100. As such, the load bearing harness 104 can help reduce impact and absorb force sustained at the helmet 102 via the connection through the flexible extension 106 in the rigid state.

The flexible extension 106 is coupled between the helmet 102 and the load bearing harness 104. Within examples, the flexible extension 106 can be made out of various materials, including, but not limited to, cloths, plastics, rope-like material, and elastic materials. In further examples, the flexible extension 106 can be made out of chain mail, rubber, or Kevlar.

In some examples, the flexible extension 106 connects to the helmet 102 and the load bearing harness 104 through one or more mechanical fasteners, such as clips or screws and bolts, etc. As such, the mechanical fasteners can enable the deconstruction of the system 100. For example, a user can disconnect the flexible extension 106 from the helmet 102 and the load bearing harness 104. In another example, the flexible extension 106 can connect via connection ports at the helmet 102 and the load bearing harness 104. In other examples, the flexible extension 106 can be built as a permanent extension between the helmet 102 and the load bearing harness 104. For example, the flexible extension 106 can form an integral attachment with the helmet 102 and the load bearing harness 104 (i.e., one piece total).

In another example, the flexible extension 106 and the helmet 102 can form a single piece that is physically separate from the load bearing harness 104. As such, the user can wear the helmet 102 with the coupled flexible extension 106 and then proceed to connect the flexible extension 106 to the load bearing harness 104 via a series of screws or other fasteners. In such a case, the helmet 102 and the flexible extension 106 can enable the force of impact to the helmet 102 to flow into the load bearing harness 104 for dissipation without a state-changing fluid entering into the flexible extension 106.

The configuration of the flexible extension 106 can differ within examples. For instance, the flexible extension 106 can include one or more inner compartments that hold a ferromagnetic infused medium or another state-changing fluid. The inner compartments can distribute the ferromagnetic infused medium throughout one or more portions of the flexible extension 106 while the ferromagnetic infused medium is in a fluid state. In another example, the flexible extension 106 can connect to a fluid source that enables ferromagnetic infused medium or another fluid to extend into portions of the flexible extension in response to the activation of a magnetic field 110 nearby the flexible extension 106.

Before an impact, near impact, or another event designed to trigger the activation of magnetic field 110, the flexible extension 106 is in a flexible state that enables the user to freely move their head. The user wearing the system 100 can look around and make other normal movements. In fact, wearing the system 100 can have a little to no impact on the range of movement of the user prior to the detection of an impact or near-term impact.

The flexible extension 106 can change from a flexible state to a rigid state. The transition between the flexible state to the rigid state and vice versa can occur quickly to protect the user of the system 100. An activation of a magnetic field 110 proximate the flexible extension 106 causes a ferromagnetic infused medium or other state-changing fluid (not shown) to transition from a fluid state to a substantially rigid state inside the flexible extension 106. The transition of the inner medium causes the flexible extension 106 to transition from the flexible state to the rigid state, which limits or even prevents the movements of the user. In particular, when the flexible extension 106 is in the rigid state, the flexible extension 106 reduces or even prevents the rotation of the user's head relative to the user's body, which can reduce the risk of injuries during an impact. As indicated above, the quick transition in a short duration can enable the system 100 to protect the head, neck, and spine of the user from a detected impact, near term impact, or another triggering event. The system 100 can also be configured to protect the user during subsequent impacts that can occur after an initial impact to the helmet 102 or another component.

In some examples, both the connections between the flexible extension 106 and the helmet 102 and the load bearing harness 104 can become rigid. The rigid connections and the flexible extension 106 in the rigid state can reduce or prevent the user from moving their head independently from moving their torso since the helmet 102 then conceptually becomes rigidly attached to the load bearing harness 104.

By restricting the movement of a user's head relative to their body, the flexible extension 106 can help align the user in a manner that enables force applied to the helmet 102 to transfer through the flexible extension 106 into the load bearing harness 104. Further, the alignment helps provide neck and head support that reduces shear and torsion stress that can occur during an impact. At the same time, the user can retain some possible movements despite the system 100 preventing rotation of their head relative to their torso.

The system 100 further includes a sensor 108. Although the sensor 108 is shown physically separate from other components of the system 100, the sensor 108 can be attached to a component or the user in other examples. Further, some example systems can include multiple sensors arranged at different locations. For example, in another implementation, the system 100 can include one or more sensors coupled to components of the system 100 and one or more sensors located physically separately.

The sensor 108 can be configured to detect an event and responsively cause the activation of the magnetic field 110 proximate the flexible extension 106. The event and type of sensor can vary depending on the desired use of the system 100. As such, the activation of the magnetic field 110 can occur quickly to enable the flexible extension 106 to transition to a rigid state in order to protect the user against harm. The sensor 108 can be configured to enable quick transformation of the flexible extension 106 from the flexible state to the rigid state in order to provide protection in response to the detection of an impact or near term impact.

In some examples, the sensor 108 is a force detection sensor configured to detect an impact or near-impact. For example, the sensor 108 can correspond to a piezoelectric sensor configured to detect changes in force by converting the changes into an electric current. When coupled to the helmet 102 or another portion of system 100, the piezoelectric sensor can detect force applied to the helmet 102. For example, the sensor 108 can be mounted on the front portion or another portion of the helmet 102. In another example, the sensor 108 can be mounted inside the helmet 102. By converting the detected force into an electric current, the electric current can cause an activation of the magnetic field 110 proximate to the flexible extension 106. In turn, the flexible extension 106 transitions from flexible to rigid enabling force to transfer from the helmet 102 into the load bearing harness 104.

In another example, the sensor 108 is an ejection seat sensor. An ejection seat is a system designed to rescue the pilot or other crew of an aircraft in an emergency. In some designs, the seat holding the user is propelled out of the aircraft by an explosive charge or rocket motor. As such, the ejection seat can eject in response to the activation of an ejection seat event, such as a button push or detection of a near-term impact to the aircraft. The sensor 108 can be configured to detect the activation of the ejection seat event and cause the magnetic field to activate proximate the flexible extension 106. For example, the sensor 108 can communicate wirelessly with a power source in order to cause the power source (e.g., a series of supercapacitors) to cause the activation of the magnetic field 110. In another example, the sensor 108 can be wired to the power source.

As shown above, the sensor 108 can be configured to detect an event and responsively cause an activation of the magnetic field 110 proximate the flexible extension 106. As such, the event can differ in some examples. For example, the event can correspond to a general impact to the helmet 102 or another portion of the system 100. Instead of a general impact, in some instances, the event can correspond to a directional impact to the helmet 102 of the system 100. In such an example, the flexible extension 106 can be made to become rigid in a manner specific to the direction of impact. In further examples, the event can correspond to an impact to the helmet 102 that is above a threshold impact level. In such an example, the sensor 108 or another component of the system 100 can measure the force of the impact. The sensor 108 can further be configured to detect subsequent impacts in order to cause the system 100 to protect the user against these impacts as well.

The magnetic field 110 is shown for illustration purposes in FIG. 1. As such, the size, position, and arrangement of the magnetic field 110 can differ within examples. For example, the magnetic field 110 can arise proximate to an electric current provided inside or on the flexible extension 106. The strength and other attributes of the magnetic field 110 can depend on the electric current or currents provided by the system 100. For example, the magnetic field 110 can activate and deactivate in response to the system 100 manipulating the electric current proximate the flexible extension 106.

FIG. 2 is another conceptual illustration of the system 100, according to an example implementation. As shown in the example implementation, the system 100 includes components depicted in FIG. 1 (helmet 102, the load bearing harness 104, the flexible extension 106, and the sensor 108) along with an additional component, a power source 112. The power source 112 can correspond to any type of source that is configured to supply an electric current along one or more wires coupled on or inside the flexible extension 106 that causes the activation of the magnetic field 110 proximate the flexible extension 106. For example, the power source 112 can correspond to a battery, a motor, or another type of source. In another example, the power source 112 is a series of supercapacitors. In some examples, the type of power source 112 used can depend on the type of sensor 108 used in the system 100.

In an example implementation, the power source 112 is a battery configured to store energy for a long period time. The battery can correspond to any type of battery, including a rechargeable battery that can receive a recharge from a source (e.g., solar power array coupled to the system 100). In further examples, movement of the system 100 can recharge the battery. As an example, the sensor 108 can transmit a signal 111 to the power source 112 to supply the electric current proximate the flexible extension 106.

In another implementation, the power source 112 can be part of the sensor 108. For example, the sensor 108 can detect an event and supply an electric current or currents along one or more portions of the flexible extension 106.

Figure 3:
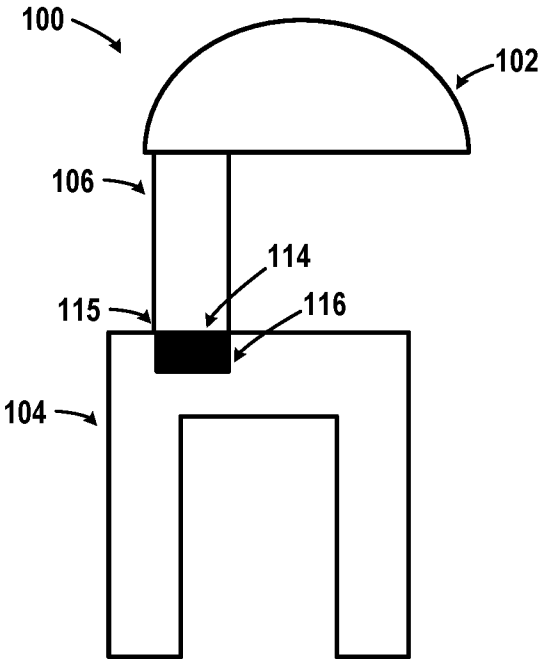
FIG. 3 is a conceptual illustration of the system with ferromagnetic infused medium in a fluid state, according to an example implementation.

FIG. 3 is a conceptual illustration of the system 100 with ferromagnetic infused medium 114 in a fluid state, according to an example implementation. As shown, the ferromagnetic infused medium 114 is stored in a compartment 116 in the load bearing harness 104 proximate an opening 115 of the flexible extension when the ferromagnetic infused medium 114 is in the fluid state. When the ferromagnetic infused medium 114 is in the fluid state, the ferromagnetic infused medium 114 is in a form that can continually flow under an applied shear stress. As a result, gravity can cause the ferromagnetic infused medium 114 to rest inside the compartment 116 in the load bearing harness 104 in the fluid state.

In other examples, the ferromagnetic infused medium 114 can be stored inside one or more portions of the flexible extension 106. In some examples, the flexible extension 106 includes one or more inner channels (e.g., tubing, compartments) that store the ferromagnetic infused medium 114 in the fluid state. The inner channels can distribute the ferromagnetic infused medium 114 in the fluid state in one or multiple portions of the flexible extension 106 such that the portions of the flexible extension 106 become rigid upon a transition of the ferromagnetic infused medium 114 from the fluid state to a substantially rigid state.

Figure 4:
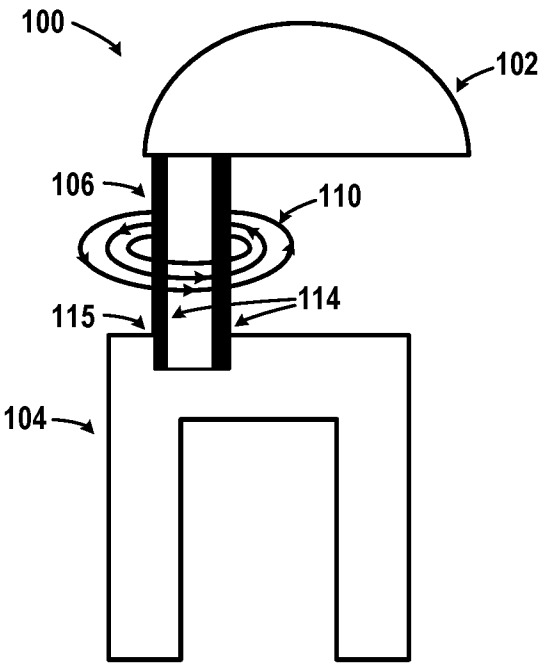
FIG. 4 is a conceptual illustration of the system with ferromagnetic infused medium in a substantially rigid state, according to an example implementation.

FIG. 4 is a conceptual illustration of the system 100 with ferromagnetic infused medium 114 in a substantially rigid state, according to an example implementation. When the activation of the magnetic field 110 proximate the flexible extension 106 occurs, the ferromagnetic infused medium 114 extends into the flexible extension 106 via opening 115. The ferromagnetic infused medium 114 is attracted to the magnetic field 110 and thus flows and hardens along portions of the flexible extension 106 positioned proximate the magnetic field 110.

As indicated above, the magnetic field 110 can be activated proximate the flexible extension 106 in response to an electric current supplied to one or more wires coupled on or in the flexible extension 106. For example, a sensor can supply the electric current in response to detecting an impact to a portion (e.g., the helmet 102) of the system 100. In another example, a sensor can cause a power supply to provide the electric current to one or more wires placed proximate the flexible extension 106 to cause the generation of the magnetic field 110.

As shown in FIG. 4, the magnetic field 110 can extend along the entirety of the flexible extension 106 causing the ferromagnetic infused medium 114 to leave the compartment 116 in the load bearing harness and extend into the flexible extension 106. In the example implementation shown in FIG. 4, the ferromagnetic infused medium 114 flows into two channels inside the flexible extension 106 and transitions into a substantially rigid state. The substantially rigid channels inside the flexible extension 106 then cause the flexible extension 106 to also become rigid. In other examples, the ferromagnetic infused medium 114 can flow into other portions of the flexible extension 106.

Figure 5:
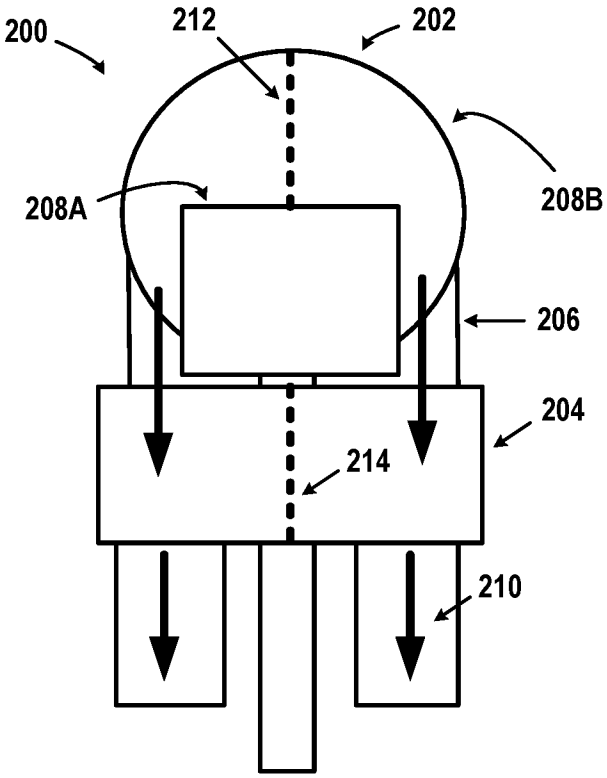
FIG. 5 is a conceptual illustration of an apparatus, according to an example implementation.

FIG. 5 is a conceptual illustration of an apparatus 200, according to an example implementation. Similar to the example system 100 shown in FIGS. 1-4, the example apparatus 200 includes a helmet 202, a load bearing harness 204 and a flexible extension 206.

As shown in FIG. 5, the helmet 202 includes a front portion 208A and a back portion 208B. When the flexible extension 206 transitions into a rigid state as a result of the ferromagnetic infused medium becoming substantially rigid, a centerline 212 that extends from the front portion 208A to the back portion 208B of the helmet 202 is aligned with a centerline 214 of the load bearing harness 204. This alignment can help reduce injury sustained by a user by providing head and neck support while also helping keep the user in a portion that is less susceptible to torsion during an impact. In addition, force applied to the helmet 202 can extend through the flexible extension 206 into the load bearing harness 204 as represented by force arrows 210. The force can then distribute in the flexible extension 206 and the load bear harness 204 in a manner that reduces impact to the user's head, neck, and spine. As such, the example apparatus 200 can limit the rate of acceleration of the user's head due to an impact to within acceptable limits. The apparatus 200 can also prevent movements beyond normal movements (e.g., physical thresholds) by varying the levels of rigidity of the flexible extension 206 over time.

Figure 6:
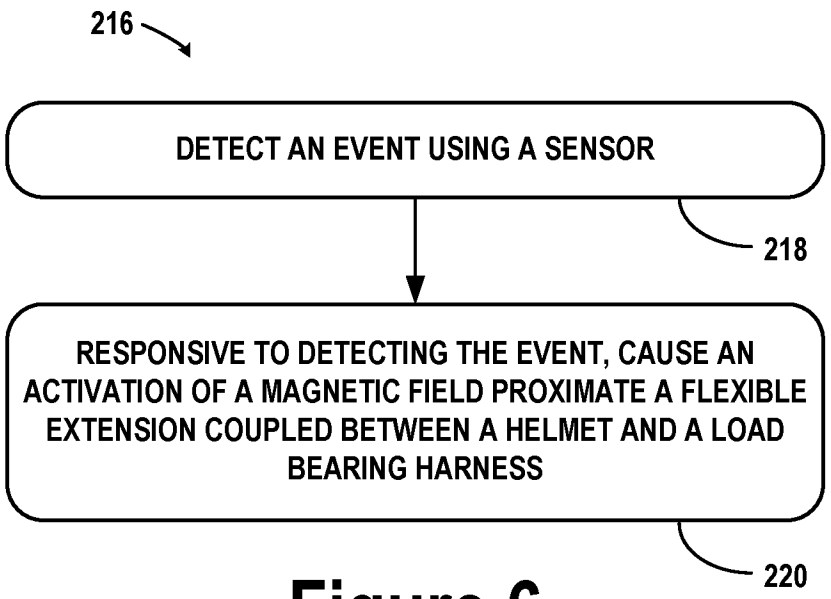
FIG. 6 shows a flowchart of a method, according to an example implementation.

FIG. 6 shows a flowchart of a method, according to an example implementation. Method 216 shown in FIG. 6 presents an example of a method that could be used with the system 100 shown in FIGS. 1-4 or the apparatus 200 shown in FIG. 5. In other examples, components of the devices and/or systems may be arranged to be adapted to, capable of, or suited for performing the functions, such as when operated in a specific manner.

Method 216 may include one or more operations, functions, or actions as illustrated by one or more of blocks 218 and 220. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

At block 218, the method 216 involves detecting an event using a sensor. For example, detecting an event using a sensor may involve detecting an activation of an aircraft seat ejection sensor using an aircraft seat ejection sensor. In another example, detecting the event involves detecting an impact to the helmet using a piezoelectric sensor. For instance, the piezoelectric sensor can have a position on or inside the helmet that can detect the force of an impact to the helmet.

At block 220, the method 216 involves responsive to detecting the event, causing an activation of a magnetic field proximate a flexible extension coupled between a helmet and a load bearing harness. In some examples, the method 216 involves transmitting a signal from the sensor to a power source responsive to detecting the event. As a result, the power source can supply a current that causes the activation of the magnetic field proximate the flexible extension.

By the term "substantially" or "about" used herein, it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

The description of the different advantageous arrangements has been presented for purposes of illustration and description, and is not intended to be exhaustive or limited to the examples in the form disclosed. Many modifications and variations will be apparent to those of ordinary skill in the art. Further, different advantageous examples may describe different advantages as compared to other advantageous examples. The example or examples selected are chosen and described in order to best explain the principles of the examples, the practical application, and to enable others of ordinary skill in the art to understand the disclosure for various examples with various modifications as are suited to the particular use contemplated.

What is claimed is:

1. A system comprising:

a helmet;

a load bearing harness;

a flexible extension coupled between the helmet and the load bearing harness, wherein an activation of a magnetic field proximate the flexible extension causes a ferromagnetic infused medium to transition from a fluid state to a rigid state causing the flexible extension to transition from a flexible state to a rigid state, wherein the ferromagnetic infused medium is stored in a compartment in the load bearing harness proximate an opening of the flexible extension when the ferromagnetic infused medium is in the fluid state, wherein the activation of the magnetic field proximate the flexible extension causes the ferromagnetic infused medium to flow from the compartment into the flexible extension along portions of the flexible extension proximate the magnetic field during the transition of the ferromagnetic infused medium from the fluid state to the rigid state, and wherein when the flexible extension is in the rigid state, force applied to the helmet transfers through the flexible extension to the load bearing harness; and a sensor configured to detect an event, wherein the sensor causes the activation of the magnetic field proximate the flexible extension in response to detecting the event.

2. The system of claim 1, wherein the load bearing harness is configured to cover shoulders of a user when the helmet is worn by the user.

3. The system of claim 1, wherein the load bearing harness is configured to absorb force received from the flexible extension.

4. The system of claim 1, further comprising:

a power source configured to receive a signal from the sensor and responsively supply a current that causes the activation of the magnetic field proximate the flexible extension.

5. The system of claim 1, wherein the flexible extension prevents rotation of the helmet relative to the load bearing harness when the flexible extension is in the rigid state.

6. The system of claim 1, wherein a centerline that extends from a front portion of the helmet and a back portion of the helmet is aligned with a centerline of the load bearing harness when the flexible extension is in the rigid state.

7. The system of claim 1, wherein the sensor is an aircraft seat ejection sensor, and wherein the event corresponds to an activation of the aircraft seat ejection sensor.

8. The system of claim 1, wherein the sensor is a piezoelectric sensor coupled to the helmet, and wherein the event corresponds to an impact to the helmet.

9. An apparatus, comprising:

a helmet configured to cover a head of a user when the apparatus is worn;

a load bearing harness configured to position over shoulders of the user when the apparatus is worn; and a flexible extension coupled between the helmet and the load bearing harness, wherein an activation of a magnetic field proximate the flexible extension causes a ferromagnetic infused medium to transition from a fluid state to a rigid state within the flexible extension causing the flexible extension to transition from a flexible state to a rigid state, wherein the ferromagnetic infused medium is stored in a compartment in the load bearing harness proximate an opening of the flexible extension when the ferromagnetic infused medium is in the fluid state, wherein the activation of the magnetic field proximate the flexible extension causes the ferromagnetic infused medium to flow from the compartment into the flexible extension along portions of the flexible extension proximate the magnetic field during the transition of the ferromagnetic infused medium from the fluid state to the rigid state.

10. The apparatus of claim 9, wherein the load bearing harness is configured to absorb force received at the helmet through the flexible extension when the flexible extension is in the rigid state.

11. The apparatus of claim 9, further comprising:

a power source configured to supply a current that causes the activation of the magnetic field proximate the flexible extension.

12. The apparatus of claim 9, wherein the flexible extension prevents rotation of the helmet relative to the load bearing harness when the flexible extension is in the rigid state.

13. A method comprising:

detecting an event using a sensor; and responsive to detecting the event, causing an activation of a magnetic field proximate a flexible extension coupled between a helmet and a load bearing harness, wherein the activation of the magnetic field proximate the flexible extension causes a ferromagnetic infused medium to transition from a fluid state to a rigid state within the flexible extension causing the flexible extension to transition from a flexible state to a rigid state, wherein the ferromagnetic infused medium is stored in a compartment in the load bearing harness proximate an opening of the flexible extension when the ferromagnetic infused medium is in the fluid state, wherein the activation of the magnetic field proximate the flexible extension causes the ferromagnetic infused medium to flow from the compartment into the flexible extension along portions of the flexible extension proximate the magnetic field during the transition of the ferromagnetic infused medium from the fluid state to the rigid state, and wherein when the flexible extension is in the rigid state, force applied to the helmet transfers through the flexible extension to the load bearing harness.

14. The method of claim 13, wherein causing the activation of the magnetic field proximate the flexible extension coupled between the helmet and the load bearing harness comprises:

responsive to detecting the event, transmitting a signal from the sensor to a power source; and supplying, by the power source, a current that causes the activation of the magnetic field proximate the flexible extension.

15. The method of claim 13, wherein detecting the event using the sensor comprises:

detecting an activation of an aircraft seat ejection sensor using the aircraft seat ejection sensor.

16. The method of claim 13, wherein detecting the event using the sensor comprises:

detecting an impact to the helmet using a piezoelectric sensor.

17. The system of claim 1, wherein a duration of the transition of the ferromagnetic infused medium from the fluid state to the rigid state depends on a strength of the magnetic field.

18. The apparatus of claim 9, wherein a duration of the transition of the ferromagnetic infused medium from the fluid state to the rigid state depends on a strength of the magnetic field.

19. The apparatus of claim 9, further comprising:

a sensor configured to trigger activation of the magnetic field.

20. The apparatus of claim 19, wherein the sensor is a piezoelectric sensor coupled to the helmet.

* * * * *